United States Patent [19]

Meyer

[11] Patent Number: 4,849,583

[45] Date of Patent: Jul. 18, 1989

[54] ELECTRICAL JOY STICK CONTROL DEVICE

[75] Inventor: Wilhelm Meyer, Vlotho, Fed. Rep. of Germany

[73] Assignee: Wilhelm Meyer GmbH & Co. KG, Kalletal-Kalldorf, Fed. Rep. of Germany

[21] Appl. No.: 219,934

[22] Filed: Jul. 15, 1988

[30] Foreign Application Priority Data

Jul. 28, 1987 [DE] Fed. Rep. of Germany ..... 3724915

[51] Int. Cl.[4] ..... H01H 25/04; H01C 10/16

[52] U.S. Cl. ..... 200/6 A; 74/471 XY; 338/128

[58] Field of Search ..... 200/5 R, 6 A, 17 R, 200/153 K; 74/471 R, 471 XY; 338/128–134, 172, 173, 191, 197, 200, 215

[56] References Cited

U.S. PATENT DOCUMENTS

| | | | |
|---|---|---|---|
| 3,818,154 | 6/1974 | Presently | 200/6 A |
| 3,942,148 | 3/1976 | Nishioka | 200/6 A X |
| 4,469,330 | 9/1984 | Asher | 200/6 A X |
| 4,531,027 | 7/1985 | Vogt et al. | 200/6 A |
| 4,559,420 | 12/1985 | Yamada | 200/6 A |
| 4,590,339 | 5/1986 | Scott-Jackson et al. | 200/6 A |
| 4,721,834 | 1/1988 | Mark et al. | 200/6 A |

*Primary Examiner*—J. R. Scott

*Attorney, Agent, or Firm*—Allegretti & Witcoff, Ltd.

[57] ABSTRACT

A control device for electrical wheelchairs or the like having a manual control lever which is so supported that it can be moved in any direction desired, and is biased into a central neutral position by means of a spring. Two electro-mechanical adjustment elements, e.g., resistors or potentiometers, are provided, the electrical starting values of which are dependent on their mechanical settings. Two mechanical transmission devices each transfer only one of two movements of the control lever in directions essentially perpendicular to one another to the mechanical-electrical adjustment elements. The mechanical transmission devices comprise two plastic plates slidably-disposed one over the other, each containing an inclined elongated slot disposed at right angles to each other. The plates carry projecting studs which actuate said electro-mechanical adjustment elements when the plates move. The lower end of the control lever moves within the elongated slots to move the plates in the desired direction and thus control the operation of the wheelchair through the electro-mechanical elements.

8 Claims, 2 Drawing Sheets

ELECTRICAL JOY STICK CONTROL DEVICE

The invention relates to an electro-mechanical control device for electrically-operated wheelchairs or the like. Such a control device is frequently called a "joy stick."

PRIOR ART

From the company document "Wheelchairs and Rehabilitation Devices" (in German) of the firm MEYRA, D-4925, Kalletal 1, August 1984, page 79, and the wheelchairs supplied by this same firm, a control device of this type has become known, in which the electromechanical adjustment elements consist of potentiometers, the axes of which, displaced by 90°, lie in a plane which is essentially vertical to the direction of movements of the control lever. The end of one arm of a U-shaped bracket is attached to the axis of the potentiometer. One arm of the control lever, which is constructed with two arms, is disposed within one of the central apertures in the bracket. Upon moving the control lever in the direction of the one aperture, the other U-shaped bracket, and thereby the potentiometer connected with it, is moved, and vice-vera. All possible intermediate forms of movement are possible, so that a practically 4-quadrant control device is formed.

The central parts of the U-shaped bracket, in which the apertures are located, are, corresponding to the movement path of the control lever, and in regard to the swiveling pivots of the same, constructed with curved surfaces. Production is thereby complicated, particularly the production of the aperture positioned in this curved part. Furthermore, an additional pivot bearing is provided on the end of the arm of the U-shaped bracket which is turned to the potentiometer. This also represents an additional construction expense. Because of the U-shaped bracket, the construction height is relatively great, a particular disadvantage, since a control device for use in a wheelchair must be accommodated in, or in the area of, the armrest of the wheelchair.

THE INVENTION

The object of the invention is to provide a control device of the type described which obviates the disadvantages of the known control device, which is simple and inexpensive in construction, and which has a low construction height.

This object is accomplished by using a pair of displaceable slide units or slotted plates. as mechanical transmission devices. Displaceable slide units result in a low construction height and are only moderately expensive. The control lever engages the slots in the displaceable plates in a simple manner. During movements which do not take place along the contour of the plate, the plate is moved and this movement is transferred to the mechanical-electrical adjustment element. The plates and their guides can be produced in a very simple manner, at low production costs.

In accordance with one form of the invention, the slide plates are displaceable in the same direction, connector link apertures or slots in the plates are reciprocally inclined to their direction of displacement. The control lever engages the sides of the apertures to move the slide plates and the mechanical-electrical adjustments elements to which they are connected. Because the slide plates are displaceable in the same direction, the same guide can be used for both, which results in simplicity of construction. The slide plates can be produced precisely, for example, by stamping.

Through the inclination of the connector link apertures, the transmission function can be varied within very wide ranges, resulting in variation in the control characteristics of the control lever. The connector link apertures are inclined at an angle of 45° to the direction of displacement. Other angles are also possible, however, through which a different control characteristic results during deflections of the control lever in various directions. One particular advantage in the use of the slots as connector links consists of the fact that they make possible, not only through their inclination, but also through their curved shape, very different control characteristics. Particularly suitable in this connection is a curvature which is centrally symmetrical of the center of the slot, and which is defined by the neutral or resting position of the control lever to provide a characteristic which is non-linear, but is still symmetrical to both directions of deflections.

In one particularly suitable form of construction the slotted plates are disposed one over the other. The guidance of the plates is provided in simple manner by means of guide apertures lying opposite to one another in the plates, and a guide pin, common to both plates, disposed in said opposed guide apertures. The pin, therefore, guides both plates at the same time. Washers on the guide pin above and below the plates provide support shoulders which hold and guide the plates as they move on the pins. These washers and the plates themselves can be produced from plastic, which requires no lubrication, thus providing a construction which is nearly completely free maintenance and wear.

In accordance with another, feature of the invention, a bushing extends through the crossing superimposed apertures in the plates, which bushing has at least one radial flange bearing against one of the plates. The control lever, having a partially spherical part on its end, engages into the bushing. By this means, a coupling, fee of clearance, of the control lever and the superimposed plates is attained. The contact point of the control lever moves on a circular path, while the plates move on a secant to this circular path.

The plates forming the slide units lie tightly, and preferably directly, on top of one another. This is constructively possible, because the guide forces are vertical to the plates and thereby the support forces of the plates on one another are very slight.

The use of slide plates makes possible another advantage of the invention. Lateral projections or depressions on the sides of the slide plates cooperate with an activating element to control a switch. Such a switch serves, in the case of a wheelchair, to carry out certain switching operations when the individual operating the chair releases the control lever. In accordance with a further development of this form of the invention, a marginal depression is provided on both slide plates which, in the neutral or inoperative position of the control lever, align with one another in such a manner that the switch is only activated when the control lever is in neutral position.

The electro-mechanical adjustment elements can, in a very simple manner, be flat sheet resistors or flat sheet potentiometers, which are connected with the slide units directly or indirectly by means of small transmission studs. Through this means there results completely linear control characteristics, while the construction height is at the same time particularly low. For electromechanical adjustment elements, rotary resistors or electrical adjustment elements can also be used to the actuating shafts of which one lever each is attached, which levers engage with studs projecting from the surface of the slide units. The position of the rotary resistors or rotary potentiometers is thereby completely free, provided that the axis of its actuating shaft is disposed vertically to the direction of displacement of the slide unit. This construction makes possible a selected arrangement of the rotary resistors or the rotary potentiometers, particularly one which is very short vertically. The lever necessary for the rotary movement of the rotary resistors or rotary potentiometers is advantageously a prong or yoke through which a stud engages the slide unit. Conversion of the linear movement of the slide unit into rotational movement of the rotary resistors or rotary potentiomenters is also possible by means of other transmission gearings, such as, for example, by means of a crank device. The adjustment elements can also operate inductively.

THE DRAWINGS

The invention will now be illustrated in further detail by means of the drawings, in which FIG. 1 is a vertical section through a control device constructed in accordance with the invention;

DETAILED DESCRIPTION

Figure 1:
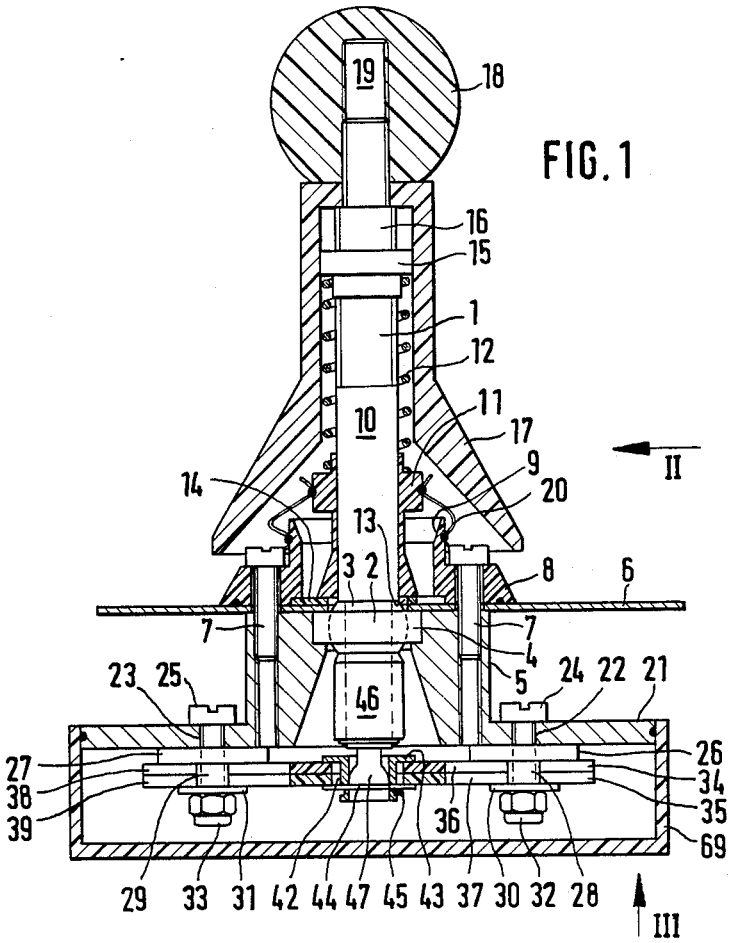

A control lever 1 has a ball and socket joint 2, the spherical part 3 of which comprises part of the control lever 1 and the stationary part 4 of which is secured to the plate 6 by means of a housing part 5, with which the entire control device can be attached to the arm rest of a wheelchair, for example, by means of screws. The housing part 5 is held by means of screws 7 which simultaneously support a stop ring 8, the stop edge 9 of which limits the deflection movements of the control lever 1.

The upper segment 10 of the control lever 1 is embraced by a moveable bushing 11, the lower end 13 of which is pressed against a disk 14 by a coil spring 12. Disk 14 is held on the upper surface of the plate 6 by the stop ring 8. The force of the pressure spring 12 is adjustable by screw ring 15 which can be moved up or down on the threaded portion 16 of the upper segment 10. The spring urges the lower end 13 of the bushing against the disk 14 and provides the restoration force for the control lever 1 as well. The upper part 10 of the lever 1 and the pressure spring 12 is covered by a cap 17 which is secured by an internally-threaded knob 18 which is screwed on the threaded end 19 of the lever 1. A flexible sealing boot 20 is provided between the bushing 11 and the stop ring 8.

The housing part 5 has a radial flange 21 containing holes 22 and 23 lying diametrically opposed to one another through which the bolts 24 and 25 extend and which hold washers 26 and 27 and bushings 28 and 29, as well as washer 30 and 31, which are all drawn against the flange 21 by means of the nuts 32 and 33.

Figure 4:
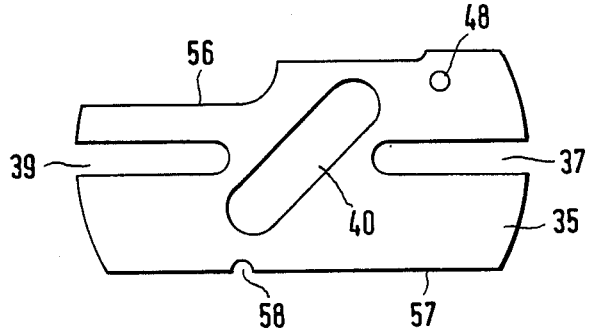
FIG. 4 is a plan view of the lower slide unit in FIG. 1.
Figure 5:
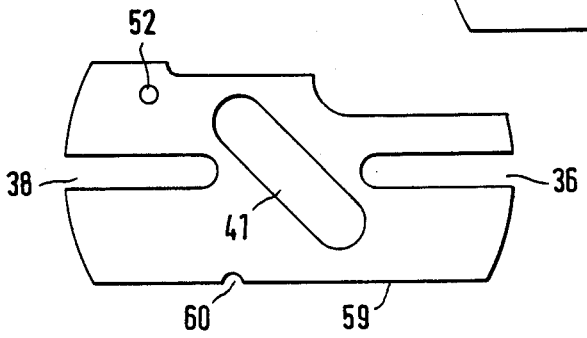
FIG. 5 is a plan view of the upper slide unit in FIG. 1.
Figure 2:
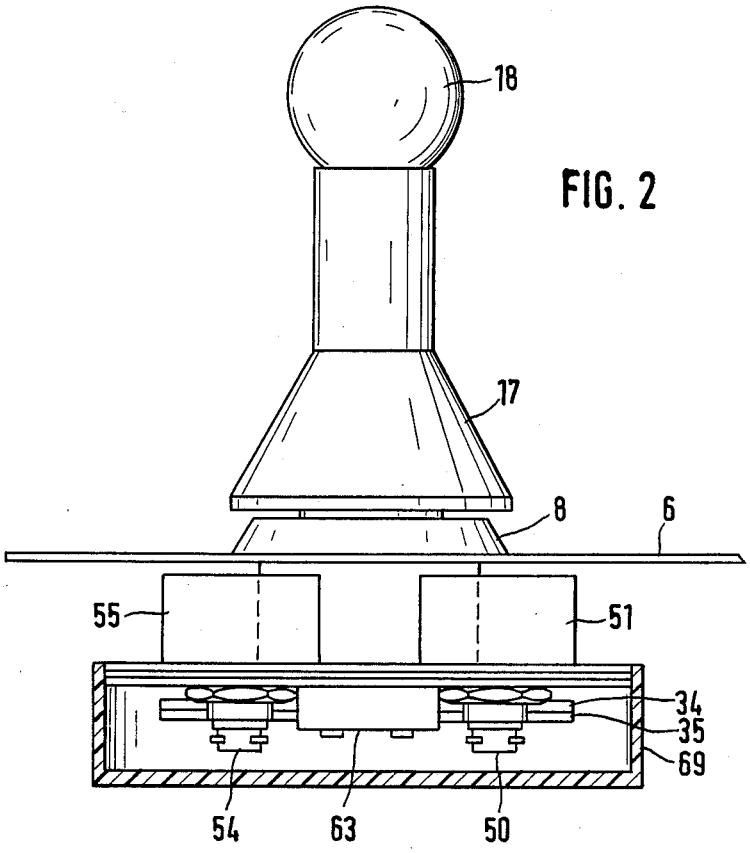
FIG. 2 is a lateral view of the control device of FIG. 1 as seen from behind the arrow II in FIG. 1.
Figure 3:
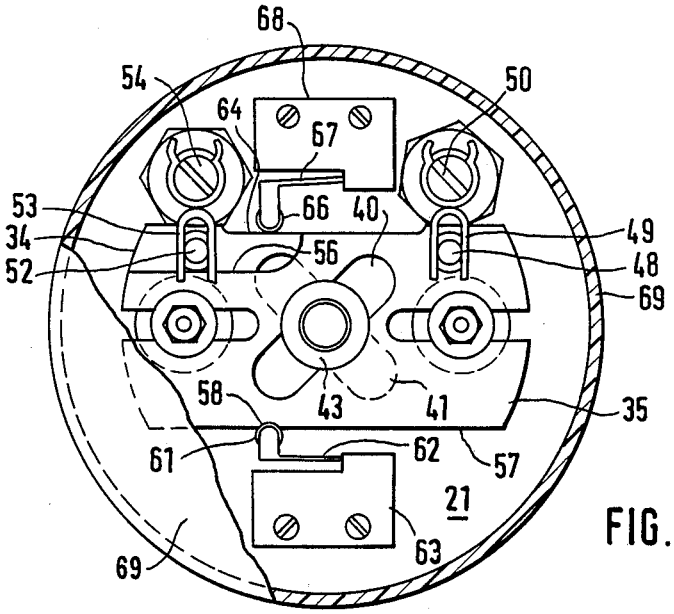
FIG. 3 is a bottom view III of the device in FIG. 1 with the lower cover cap removed.

Between the washers 26, 27 and 30, 31, two plates 34 and 35 are slidably disposed. The bushings 28 and 29 slide in the elongated guide apertures 36 and 37 in the plates 34 and 35 in a manner which is free from clearance. The construction of the plates 34 and 35 and the arrangement of the apertures 36 and 37 are best shown in FIG. 3–5. The plates 34 and 35 are movable along the axes of the apertures 36, 38 and 37, 39 in an easily displaceable manner and free from clearance. Vertically-aligned 38 and 39 in the stacked plates 34 and 35, respectively, surround bushing 29 within which the bushing 29 slides in a manner free of clearance. Similarly apertures 36 and 37 surround bushing 28.

Between the apertures 39 and 37 there is located in the plate 35 a connector slot 40 which is inclined at an angle of to 45° the direction of plate movement i.e., along the axes of elongated apertures 37, 39. A similar connector slot 41 is provided in the plate 34 between apertures 38 and 36, inclined at an angle of 45° in a direction opposite aperture 40. As can be seen from FIG. 3, in connection with FIG. 1, a bushing 42 extends through the crossing connector link apertures 40 and 41 of superimposed plates 34 and 35, which bushing is so dimensioned that it can slide in the connector slots in a manner free of clearance. There is located on the bushing 42 a radial flange 43 which bears against the upper surface of 34 in a sliding manner. A washer 44 is slid onto the other end of the busing 42 which abuts the underside of plate 35 and is held on the bushing by means of a security retaining ring 45.

As is evident from FIG. 1, there is located on a lower segment 46 of the control lever 1 a partially spherical part 47 which snugly engages the interior surface of the bushing 42 and is therefore in a position to transfer the movements of the control lever 1 to the bushing 42 in a manner which is free of clearance.

A stud 48 projects above the surface of the plate 35 which engages without clearance in the opening of a prong or fork 49 which is attached as a lever to a shaft 50 of a potentiometer 51 so that during the displacement of the plate 35 and thereby of the stud 48, the forked lever 49 is swivelled, and the shaft 50 of the potentiometer 51, to which it is fixed, is turned.

In the same way, there is located on the plate 34 a stud 52 which engages in the free opening of forked lever 53 which lever is attached to shaft 54 of a potentiometer 55. In the range of movement of the stud 52, the plate 35 has a recess or cut-out 56 so that the stud 52 can be moved without engaging the plate 35.

As evident from FIGS. 4 and 5, there is located on one edge 57 of the plate 35 a depression or cut out portion 58. On the corresponding edge 59 of the plate 34, a similar depression 60 is located. These depressions 58, 60 cooperate with a control roller 61 on an activating arm 62 of a microswitch 63. In the position depicted in FIG. 3, the control roller 61 rests in the depressions 58, 60 lying directly above one another, so that the microswitch 63, depending on its function, is closed or opened. When the plates 34 or 35 move laterally, the roller 61 emerges from the depressions to open or close the switch, as the case may be.

The edges 64 and 65 lying opposite one another have longitudinally extending depressions, which cooperate with a control roller 66 on an activating arm 67 of a microswitch 68, whereby the activation of this microswitch 68 is effected in the final displacement position of the plates 34 and 35.

As is evident from FIG. 1, the entire part of the device lying below the plate 6 is protected against moisture and dust by the housing 5 and a covering cap 69 placed on the flange 21.

As can be seen from FIGS. 1 and 3, upon activating the control lever 1 in the direction of the connector link aperture 40, the bushing 42 is pressed against the edge of connector link aperture 41 so that the corresponding plate 34 is displaced and the shaft 54 of the corresponding potentiometer 55 is rotated through the stud 52 means of the lever 53. If the control lever 1 is moved in the direction of the connector link aperture 41, the bushing 42 presses against the lateral edge of the connector link aperture 40 so that the lower plate 35 is displaced, and the axis 50 of the potentiometer 51 is turned by means of the stud 48 and the lever 49. During movements in other directions, both plates 34 and 35 are moved more or less simultaneously, so that the potentiometers 51 and 55 are displaced more or less correspondingly. The control lever 1 can also be activated by foot, rather than by hand.

What is claimed is:

1. A central device for electrically-operated wheel chairs or the like comprising;

a support plate;

a central lever mounted on a universal joint in said support plate;

a spring surrounding said control lever for biasing said lever to a neutral non-operative position;

a housing disposed beneath said support plate;

a pair of electro-mechanical adjustment elements mounted on said housing, the electrical actuating values of which depend upon their mechanical settings;

a pair of linearly displaceable slide plates within said housing, one disposed above the other;

each said plates having a pair of elongated aligned guide apertures at opposed ends thereof, the apertures in the top plate being superimposed with the apertures in the bottom plate;

pins mounted on said housing and extending into said superimposed apertures to cause both plates to be displaceable along the axis of said apertures;

a connector slot in each plate, said slots being disposed at approximately right angles to each other and inclined at an acute angle to the direction of plate displacement;

said control lever engaging said connector slots to actuate said plates, and means connecting said slide plates to said electro-mechanical adjustment elements.

2. The control device of claim 1 in which said connector slots have curved ends symmetrical with the mid point of said slots and said angle of inclination is approximately 45°.

3. The control device of claim 1 in which said connector slots cross each other at their mid points when said control lever is in said neutral position.

4. The control device of claim 3 which includes a bushing extending through said cross linked connector slots, said bushing having a peripheral flange overlying the marginal edge of the slot in the upper plate and in which said control lever has a partially spherical portion on the lower end thereof disposed within said bushing.

5. The control device of claim 1 in which each of said slide plates has a notch depression in one edge thereof, said depressions being vertically aligned when said control lever is located in said neutral position, and said device includes a switch having an actuating element adjacent said aligned depressions, said actuating element lying within said notch depressions to actuate said switch.

6. The control device of claim 1 in which said connecting means comprises a stud on each said slide plate, said electro-mechanical adjustment elements are resistors or potentiometers having a rotary control shaft, a lever connected to said shaft, said lever engaging said stud to actuate said resistor/potentiometer when said slide plates are displaced.

7. The control device of claim 6 in which said lever is a prong having a pair of arms engaging said stud.

8. The control device of claim 5 which includes an elongated depression along the edge of each plate opposite the edge carrying said notch depressions, and said device has a switch with an actuating element adjacent said elongated depressions which is actuated by said elongated depression when the plates slide.

* * * * *